US005282992A

United States Patent [19]

Reichgott

[11] Patent Number: 5,282,992

[45] Date of Patent: Feb. 1, 1994

[54] LUBRICATING METAL CLEANER ADDITIVE

[75] Inventor: David W. Reichgott, Richboro, Pa.

[73] Assignee: Betz Laboratories, Inc., Trevose, Pa.

[21] Appl. No.: 864,712

[22] Filed: Apr. 7, 1992

[51] Int. Cl.[5] ..... C10M 133/06; B08B 3/04

[52] U.S. Cl. ..... 252/51.5 R; 252/50; 252/49.3; 252/156; 252/548; 134/2; 134/4; 134/22.19; 134/23

[58] Field of Search ..... 252/51.5 R, 50, 49.3, 252/548, 156; 134/2, 4, 22.19, 23

[56] References Cited

U.S. PATENT DOCUMENTS

| | | | |
|---|---|---|---|
| 2,917,160 | 12/1959 | Turinsky | 252/34 |
| 3,186,946 | 6/1965 | Sluhan | 252/49.3 |
| 3,520,820 | 7/1970 | Hwa | 252/392 |
| 3,657,129 | 4/1972 | Obermeier | 252/51.5 R |
| 3,779,933 | 12/1973 | Eisen | 252/118 |
| 3,847,663 | 11/1974 | Shumaker | 252/135 |
| 4,176,059 | 11/1979 | Suzuki | 210/58 |
| 4,237,021 | 12/1980 | Andlid et al. | 252/49.5 |
| 4,260,502 | 4/1981 | Slanker | 252/49.5 |
| 4,808,235 | 2/1989 | Woodson et al. | 252/548 |
| 4,834,912 | 5/1989 | Hodgens et al. | 252/548 |
| 4,859,351 | 8/1989 | Awad | 252/32.5 |
| 4,948,521 | 8/1990 | Stewart, Jr. et al. | 252/33 |
| 5,061,389 | 10/1991 | Reichgott | 252/49.3 |
| 5,075,040 | 12/1991 | Rivenaes | 252/548 |
| 5,080,814 | 1/1992 | Awad | 252/49.3 |
| 5,145,608 | 9/1992 | Wershofen | 252/548 |

FOREIGN PATENT DOCUMENTS 795715 10/1968 Canada .

OTHER PUBLICATIONS

Doyle et al, "Manufacturing Processes and Materials For Engineers," Prentice-Hall, N.J., pp. 244 and 691-693 (1961).

Little, *Metalworking Technology*, McGraw-Hill Book Co, NY, p. 379 (1977).

Chem. Abstracts 81 (26) 174012t, 1974.

*Primary Examiner*—Prince Willis, Jr.

*Assistant Examiner*—Alan D. Diamond

*Attorney, Agent, or Firm*—Alexander D. Ricci; Steven D. Boyd

[57] ABSTRACT

An additive for a single stage aqueous alkaline cleaning composition for metal surfaces which imparts improved lubricity to the metal surfaces being treated. The additive is a fatty amine, preferably an ethoxylated fatty diamine.

7 Claims, No Drawings

LUBRICATING METAL CLEANER ADDITIVE

FIELD OF THE INVENTION

The present invention relates to the cleaning of metal surfaces with aqueous alkaline cleaners. More particularly, the present invention relates to additives to aqueous alkaline metal cleaning solutions which lower the coefficient of friction of cleaned metal surfaces.

BACKGROUND OF THE INVENTION

Single stage cleaning of metal surfaces with aqueous alkaline cleaning solutions is known. The cleaning solutions remove coolants and lubricants employed in machining operations. Metal fines and other contaminants from metal forming and machining operations are also removed by the cleaning process. Conventional cleaners frequently result in a surface finish which is susceptible to oxidation and/or an increased coefficient of friction over time. For metal articles which are machined to close tolerances such surface degradation can have a deleterious effect on later operations such as automated assembly operations. In assembly operations by automated equipment such surface degradation i.e., high coefficient of friction, may cause jamming or require decreased operating speeds for the equipment. High coefficients of friction may also cause automated assembly equipment to reject an excessive number of parts. An excessively thick oxide layer may actually prevent entry of a part into an automated machining process.

The use of automated machinery and assembly equipment is common, for example in the production of automotive engines and transmissions. A need exists in the metal treatment industry for cost effective, simple means to modify the coefficient of friction of machined articles and inhibit oxide growth in order to improve their assembly properties. A reduction in the coefficient of friction and the maintenance of a low coefficient of friction over time will improve the ease of assembly for articles machined to close mechanical tolerances.

Those practiced in the art know that the coefficient of static friction between two surfaces is almost always larger than the coefficient of kinetic friction. A high coefficient of static friction is generally a limiting factor in assembly operation speed. A reduction in the coefficient of static friction will improve, by decreasing, the rejection rate of parts by automatic assembly equipment. This will allow more efficient production. It also may be possible to increase the speed of the assembly operation.

It is therefore desirable to improve, by decreasing, the coefficient of friction of machined metal articles which are cleaned by an aqueous alkaline cleaner. It is an object of the present invention to improve the coefficient of friction of machined metal articles which are cleaned by aqueous alkaline cleaners.

Lubricity-imparting additives are known in the aluminum beverage container industry. See for example U.S. Pat. Nos. 4,859,351 Awad and 5,061,389, Reichgott. The additives described in the prior art are preferably applied after cleaning and rinsing of the aluminum. The additives described in the prior art may be inappropriate in single-stage cleaning solutions for several reasons. The prior art additives, such as ethoxylated fatty acids and polyethylene glycol esters may not resist alkaline hydrolysis in an alkaline cleaner concentrate or cleaner bath. The delay between cleaning and subsequent machining steps in the present invention may be several weeks where as the delays between cleaning and printing steps for beverage containers is typically on the order of minutes.

The requirements of a single stage cleaning process are substantially different than other metal cleaning operations. Only a single pH may be used. Intermediate rinses are not available to remove soils and metallic fines. The cleaning solution must drain efficiently from the cleaned surface. Also, the growth of oxide layers on the metal surface must be controlled after oils have been removed by the cleaner. The current use of chlorinated solvents to accomplish these goals is under increasing pressure from both health and environmental regulation.

SUMMARY OF THE INVENTION

The present invention provides an additive for a single stage aqueous cleaning composition for metal surfaces which imparts improved lubricity to the metal surfaces being treated. By improved lubricity it is meant that the coefficient of friction for the cleaned metal surface is decreased and shows a tendency to stay low over time.

The additive of the present invention is a fatty amine or preferably, an ethoxylated fatty diamine. The addition of an ethoxylated fatty diamine to a commercial alkaline cleaner which is formulated to leave a low residue on a cleaned metal surface was found to impart a lower coefficient of friction to the surface. The treatment also minimized the increase in the coefficient of friction for the metal surface over time. Furthermore, the growth of aluminum oxide on treated aluminum was inhibited. It is believed that the use of ethoxylated fatty amines alone, without addition to a cleaner, would provide improved lubricity to clean metallic surfaces if applied thereto.

DETAILED DESCRIPTION OF THE INVENTION

The combination of a fatty polyamine and an alkaline cleaner was found to impart improved lubricity to metallic surfaces. The fatty polyamine is preferably an ethoxylated fatty diamine. The preferred ethoxylated fatty diamine is a commercial material produced by the condensation of a fatty (C-12 to C-18) N-alkyl trimethylene diamine with an average of 10 moles of ethylene oxide sold under the tradename Ethoduomeen T/20 by Akzo Chemie America of Chicago, Ill.

The combination of an alkaline cleaner and an ethoxylated polyamine of the present invention avoids the use of hydrocarbon oils, thioureas and other corrosion inhibitors which pose significant health risks. The combination of the present invention provides good efficacy for heavy soils and fines removal along with good lubricity. The results are particularly important when machined parts are to be cleaned prior to handling by automated tooling and assembly equipment with fine tolerances.

It is believed that the ethoxylated polyamine of the present invention may also be used apart from the cleaner in order to provide improved lubricity to clean metallic surfaces.

The present invention will be further illustrated, but is not limited by, the following examples.

EXAMPLE 1

Diecast aluminum sleeves, about 8 cm in length, 2 cm in diameter, and weighing approximately 46 grams, were obtained from a manufacturing facility. They were received wet, soaked with a coolant emulsion used in the tooling operation that preceeds the cleaning process. Each sleeve also had a coating of oil and aluminum fines.

The sleeves were cleaned by immersion in aqueous test cleaner baths that also contained 1% of the commercial coolant concentrate, Cimperial 1010 (a proprietary product of Cincinnati Milarcron). After immersion for 30 seconds at 150 degrees F., the sleeves were drained, but not rinsed, and then allowed to dry at room temperature for 24 hours.

A comparison was made using 2% aqueous dilutions of a commercial cleaner concentrate with and without addition of an ethoxylated polyamine. Table 1 summarizes the treatment formulations.

TABLE 1

| Component | Present Invention | Commercial Cleaner |
|---|---|---|
| Tap Water | 63.2 | 66.2 |
| KOH (45%) | 5.0 | 5.0 |
| Sodium tripolyphosphate | 4.0 | 4.0 |
| Triethanolamine | 8.0 | 8.0 |
| "Silicate D" (*) | 5.0 | 5.0 |
| Gluconic Acid (50%) | 2.0 | 2.0 |
| Surfonic N-95 (*) | 5.0 | 5.0 |
| Triton DF-20 (*) | 1.8 | 1.8 |
| Petro 22 (*) | 3.0 | 3.0 |
| Ethoduomeen T/20 (**) | 3.0 | 0 |

(*) Silicate D is a commercial sodium silicate solution in water, 29.4% as $SiO_2$, and 14.7% as $Na_2O$, available from Philadelphia Quartz.
Surfonic N-95 is a commercial ethoxylated nonylphenol, available from Jefferson Chemical Co.
Triton DF-20 is a proprietary commercial polyoxyethylene surfactant, available from Rohm and Haas.
Petro 22 is a commercial sodium methyl naphthalene sulfonate, available from Desoto Chemical.
(**) Ethoduomeen T/20, is available from Akzo Chemie.

When the parts were removed from either of the two 2% cleaner baths, they were free of visible oil, and a deposit of metal "fines" could be seen at the bottom of the vessel. (It is noteworthy that when these parts were solvent-extracted, in lieu of alkaline cleaning, a layer of white aluminum oxide developed within one day.)

Coefficients of static friction were determined using an inclined plane. In this method, two sleeves are placed parallel to each other, against a stop that is parallel to the hinge of the plane. Positioning feet retain the sleeves in a parallel orientation about 0.5 cm apart at the sides, and they ensure reproducible placement. A third sleeve is placed parallel to, and resting on the other two. The edges are offset to overhang by about 1 cm so the edges are not in contact. The plane is inclined slowly. The angle at which the upper sleeve begins, and continues to slide along the lower sleeves is recorded. The sleeves are then interchanged, so that each sleeve is in each of the three possible positions for two trials. The six angles of incline are averaged. The coefficient of static friction is the tangent of this angle.

Coefficients of friction were obtained when the parts were fully dry (ca. 24 hours), and again after one week:

| | Commercial Cleaner | Present Invention |
|---|---|---|
| 1 day | 0.38 | 0.37 |
| 7 days | 0.44 | 0.38 |

While both cleaning compositions gave initially low coefficients of friction, the addition of the ethoxylated polyamine prevented the change with time.

EXAMPLE 2

To further illustrate the effect of the ethoxylated polyamine, field-cleaned parts that had coefficients of friction of 0.47 were recleaned in the laboratory as described above, except that the coolant/contaminant was Cimperial 16 (Cincinnati Milarcron). The coefficients of friction were:

| | Commercial Cleaner | Present Invention |
|---|---|---|
| 1 day | 0.60 | 0.34 |
| 7 days | 0.58 | 0.38 |

While recleaning gave significantly higher coefficients of friction for the commercial cleaner vs. Example 1, the present invention gave lower values.

As can be seen from the above examples, the addition of an ethoxylated polyamine to an alkaline aqueous cleaner improved lubricity both short term and long term.

EXAMPLE 3

Field-cleaned parts (coefficient of friction=0.51) were immersed in an aqueous solution of octadecylamine (0.6 g/l), morpholine (1.2 g/l), and an ethoxylated fatty alcohol (Brij 35, 0.3 g/l). This solution was prepared from Neutrafilm 463, available for Betz Laboratories, Trevose, Pa. 2% in tap water. Upon drying, the coefficient of friction was 0.31.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A method of cleaning and lubricating the external surfaces of a machined metal structure prior to metal to metal contact comprising applying to said external surface a cleaning and lubricating composition comprising an aqueous alkaline cleaning solution and a fatty polyamine lubricity improving agent and drying said cleaning and lubricating composition in place.

2. The method of claim 1 wherein said fatty polyamine lubricity improving agent comprises an ethoxylated fatty diamine.

3. The method of claim 2 wherein said ethoxylated fatty diamine is produced by condensation of fatty (C-12 to C-18) N-alkyl trimethylene diamine with an average of 10 moles of ethylene oxide.

4. A method of reducing the coefficient of friction in subsequent metal to metal contact of a metal surface cleaned by an aqueous alkaline cleaner which comprises contacting the clean metal surface with octadecylamine which is dried in place.

5. A method of cleaning and reducing the coefficient of friction in subsequent metal to metal contact of a metal surface which comprises contacting the metal surface with a combination of an aqueous alkaline cleaner and an ethoxylated fatty polyamine and drying said combination in place.

6. The method of claim 5 wherein said ethoxylated fatty polyamine is produced by condensation of a fatty (C-12 to C-18) N-alkyl trimethylene diamine with an average of 10 moles of ethylene oxide.

7. A method of cleaning and reducing the coefficient of friction in subsequent metal to metal contact of a metal surface which comprises contacting the metal surface with a combination of an aqueous alkaline cleaner and octadecylamine and drying said combination in place.

* * * * *